US006359389B1

(12) United States Patent
Medina et al.

(10) Patent No.: US 6,359,389 B1
(45) Date of Patent: Mar. 19, 2002

(54) FLAT PANEL DISPLAY SCREEN WITH PROGRAMMABLE GAMMA FUNCTIONALITY

(75) Inventors: Oscar I. Medina, San Jose; Jonathan D. Mendelson, Mountain View; Daniel E. Evanicky, San Jose, all of CA (US)

(73) Assignee: Silicon Graphics, Inc., Mountain View, CA (US)

( * ) Notice: Subject to any disclaimer, the term of this patent is extended or adjusted under 35 U.S.C. 154(b) by 0 days.

(21) Appl. No.: 09/590,887

(22) Filed: Jun. 9, 2000

(51) Int. Cl.[7] ..... G09G 3/10

(52) U.S. Cl. ..... 315/169.1; 315/169.3; 315/169.4; 345/58; 345/60

(58) Field of Search ..... 315/169.1, 169.3, 315/169.4; 345/58, 60

(56) References Cited

U.S. PATENT DOCUMENTS 4,496,879 A * 1/1985 Suste ..... 315/169.4
5,619,221 A * 4/1997 Hirai et al. ..... 345/58
5,751,261 A * 5/1998 Zavracky et al. ..... 345/55
5,999,630 A * 11/1999 Nakamura ..... 315/169.4

* cited by examiner

*Primary Examiner*—Don Wong
*Assistant Examiner*—Jimmy T. Vu
(74) *Attorney, Agent, or Firm*—Wagner, Murabito & Hao LLP

(57) ABSTRACT

A flat panel display having a programmable gamma without incidental loss in gray scale resolution. In one embodiment, the flat panel display is a liquid crystal display (LCD). The invention includes applying and adjusting a set of gamma controlling voltages to the DC reference circuit (a.k.a. ladder voltages) of an LCD module producing a change in the gamma response (or profile) of the LCD module without incidental loss of gray scale resolution. An adjustable ladder circuit (ALC) is thereby realized. Separate ALCs can be provided for red, green and blue primaries. By adjusting, in a predetermined fashion, the reference voltages applied to the row and column drivers of an LCD display, the gamma response of the LCD can be changed to a different value. Because the input digital signals are not affected, the same color resolution and dynamic range are maintained. The DC reference circuit can be a multi-node voltage divider. These voltage nodes are applied to the row and column drivers of the LCD module to control the ON/OFF states of each red, green and blue sub-pixel. The input digital signals provided by the host's graphic source or software application modulate these voltage nodes to produce the desired gray scale value applying across the LCD sub-pixel a percentage of DC reference voltages.

22 Claims, 6 Drawing Sheets

FLAT PANEL DISPLAY SCREEN WITH PROGRAMMABLE GAMMA FUNCTIONALITY

BACKGROUND OF THE INVENTION (1) Field of the Invention

The present invention relates to the field of display devices. More specifically, the present invention relates to the field of flat panel display devices having adjustable gamma responses.

(2) Background

Flat panel or liquid crystal displays (LCDs) are popular display devices and are used in computer systems, multimedia systems and other consumer electronic devices. Many types of flat panel displays are typically back-lit or edge-lit. That is, a source of illumination is placed behind the LCD layers to facilitate visualization of the resultant image. The LCD material acts as a regulator of light passing through color filters and to the eye, thereby forming an image. Flat panel LCD units are used today in many applications including the computer component industry and the computer peripheral industry where flat panel LCD units are an excellent display choice for lap-top computers and other portable electronic devices. Flat panel LCD displays are also being used in the high end graphic arts industry where display quality and realistic image quality are very important consumer goals.

In the field of flat panel LCD devices, much like conventional cathode ray tube (CRT) displays, a pixel is composed of a red, a green and a blue color point or "spot." When each color point of the pixel is illuminated simultaneously, and with the appropriate intensity, white can be perceived by the viewer at the pixel's screen position. To produce different colors at the pixel, the intensities (e.g., brightness) to which the red, green and blue points are driven are altered in well known fashions. The separate red, green and blue data that correspond to the color intensities of a particular pixel are called the pixel's color data. Color data is often called gray scale data. The degree to which different colors can be achieved by a pixel is referred to as gray scale resolution. Gray scale resolution is directly related to the amount of different intensities (e.g., luminosities) to which each red, green and blue point can be driven.

All color systems must accurately reproduce the color tones of the original scene. Since no known reproduction process can exactly capture the original elements in a given situation (e.g., the brightness of the sun shining down on a landscape), the basic goal of reproduction is to capture the relative differences between objects in the original view. The ratio of the whitest point to the blackest point in a scene is know as its dynamic range, which must be reproduced on some medium such as film, a CRT, an LCD, or paper. The characteristics of this medium, or its "native response," will determine the level of success a given reproduction achieves.

The number of steps, or gray scale, into which this dynamic range can be subdivided determines the resolution of a particular primary color. A typical monitor system will have the ability to display 8-bits, or 256 shades per primary color for a total of over 16.7 million colors (256×256×256). This is known as the color depth or image palette of the display system.

These display mediums, especially CRTs, although they behave in a fairly linear fashion, introduce some amount of distortion which has to be corrected to make the reproduced image look "proper." Human eyes see logarithmically. To compensate for this, monitors are made to mimic the eye's viewing so that the display shows the eye information in a way people are used to seeing. The resulting response curve varies in an exponential manner known as the "gamma curve," which is a polynomial equation describing any point on a brightness curve being displayed by a particular monitor. Its function is to correct for the non-linearity of the input signal and its corresponding luminance. Using CRTs as an example, the brightness changes very little at the lower energy gray levels causing some compression of the shadow detail where our eyes are the most sensitive. So instead of a straight-line, linear response where there is a equal amount of output change for a given input change, the gamma curve has a long, shallow beginning before it begins to climb.

Traditionally, display management systems manipulate the shape of the gamma curve through the use of color lookup tables ("LUTs") in a memory location some where in the data information path on the host computer or graphics card. The LUT contains one entry, typically, per gray scale level. The information bits that make up an image are converted from one value to another, as in the following equation, on their way to the display device. This method has farther reaching applications.

$$RGBc=RGBc-\max[[-kop+(RGBin/(RGBin-\max))^{(1/x)}]/Kgp]$$

where:

RGBc=corrected RGB value

RGBc−max=maximum of corrected RGB values ($2^n-1$)

RGBin=RGB input value

RGBin−max=maximum of RGB input values ($2^n-1$)

Kop, Kpg, x=fitted parameters of display primary channel

By using LUTs to alter the gamma curve, the host computer system or graphics card can impact the luminance (brightness) as well as the color temperature of the monitor.

There are strong historical reasons why particular gamma responses have been selected by different display customer segments. For instance, different displays may have different gamma responses. In some instances, however, the gamma response of a display is based on the type of work for which display is used. For instance, a digital television (TV) or web based TV may use a different gamma response than a high end graphics computer aided design system, etc. Further, print media may select 1.8 gamma and film media may use 2.2 gamma. Further, the gamma response of a display device may be altered depending on the environment in which the screen is used, e.g., the lighting characteristics of the office, etc. The displays available today solve these issues on an independent, case-by-case basis. Different displays may have different gamma responses. Therefore, it is advantageous to provide a display device that has an adjustable gamma response. It is further advantageous to provide a display device that could give the display added flexibility to solve all such applications well.

There is a disadvantage in using LUTs to correct the normal gamma setting, the color temperature, and the brightness at which a particular display operates: the overall luminance and color resolution (e.g., the "color depth") of the displayed data can be compromised by using LUTs to correct the normal gamma setting. Adjusting these three image elements in this manner can use up to 2 bits of information in a memory register that would normally be applied toward describing the tonal qualities of the image itself. Loss of 2 bits of color depth in an 8-bit system means that the user is being deprived of 16.52 million colors ($2^8\times2^8\times2^8-2^6\times2^6\times2^6$) out of a possible palette of 16.78 million. Traditional solutions increase the addressable memory depth in the host or the graphics card to 10-bits in order to over-sample the RGB input, apply the correction, and then down-sample to preserve the original column information. However, this is costly and difficult to implement. Therefore, using LUTs to correct the normal gamma setting can lead to a degradation of the overall gray scale resolution of a monitor. Therefore, it is advantageous to provide a display device that has an adjustable gamma response without an incidental degradation of gray scale resolution.

SUMMARY OF THE INVENTION

Accordingly, it would be advantageous to provide a display that allows its gamma response to be altered without any incidental loss in gray scale resolution. It would also be advantageous to provide a display that allows its gamma response to be altered, via software control, without any incidental loss in gray scale resolution. It would also be advantageous to provide a flat panel LCD display that allows its gamma response to be altered, via software control, without any incidental loss in gray scale resolution. It would be advantageous to provide a display that can alter its gamma without requiring external RGB gamma LUTs in the host computer. These and other advantages of the present invention not specifically described above will become clear within discussions of the present invention herein.

Embodiments of the present invention offer a novel solution to this problem in that the gamma of the display system can be altered within the flat panel itself rather than resorting to LUTs in graphics memory locations. Coupled with inventions disclosed in previous filings pertaining to separate backlight color adjustment methods and separate backlight luminance control such as Ser. No. 09/087,280 entitled "A LIQUID CRYSTAL FLAT PANEL DISPLAY WITH ENHANCED BACKLIGHT BRIGHTNESS AND SPECIALLY SELECTED LIGHT SOURCES" filed on Jun. 26, 1998, Ser. No. 09/087,745 entitled "A MULTIPLE LIGHT SOURCE COLOR BALANCING SYSTEM WITHIN A LIQUID CRYSTAL FLAT PANEL DISPLAY" filed Jun. 26, 1998 and Ser. No. 09/187,161, entitled "A method and System for Providing a Colorimetric Reference Profile for a Flat Panel Monitor" filed Nov. 11, 1998, each of the three main elements of the display system may be controlled separately and independently of any other element. The present invention is especially useful for graphic arts, multimedia, and film production applications where preserving color depth and maintaining color control is critical.

Future flat panel displays may incorporate more than three color primaries, thereby offering the user a greater color space. This invention applies even to that wider gamut in retaining more color information by maintaining independence between the critical elements of the display and the print or film output segments of color work product.

A flat panel display is described herein having a programmable gamma without incidental loss in gray scale resolution. In one embodiment, the flat panel display is a liquid crystal display (LCD). The invention includes a method of applying and adjusting a set of gamma controlling voltages to the DC reference circuit (a.k.a. ladder voltages) of an LCD module producing a change in the gamma response of the LCD module without incidental loss of gray scale resolution. An Adjustable Ladder Circuit (ALC) is thereby realized. Separate ALCs can be provided for red, green and blue primaries. By adjusting, in a predetermined fashion, the reference voltages applied to the row and column drivers of an LCD display, the gamma response of the LCD can be changed to a different value. Because the input digital signals are not affected, the same color resolution and dynamic range are maintained, but the gamma now is a function of the setting of the reference voltages and is not a function of the contents of any gamma LUTs (located within the host) which are not required by the present invention.

The DC reference circuit, in its simplified form, is a multi-node voltage divider circuit. These reference voltage nodes are applied to the row and column drivers of the LCD module to control the ON/OFF states of each red, green and blue sub-pixel. The reference voltages corresponding to these nodes can be altered in accordance with the present invention to achieve a desired gamma response. The input digital signals provided by the host's graphics source modulate these voltage nodes to produce the desired gray scale value, applying across the LCD sub-pixel a percentage of DC reference voltage.

Specifically, one embodiment of the present invention includes a monitor comprising: a flat panel display screen comprising rows and columns; a circuit producing the LCD's DC reference voltages which are supplied to row and column driver circuits; a timing controller producing the timing signals applied to the row and column driver circuits; and a controller device for applying and adjusting gamma controlling voltages to the DC reference voltages. These controlling voltages alter the gamma response of the flat panel display screen without degrading its gray scale resolution.

Further embodiments include a monitor wherein the controller device is a source of programmable voltages and wherein the source of programmable voltages comprises a plurality of summing amplifiers for each node of the DC reference circuit. Further embodiments include a monitor circuit wherein the flat panel display screen is a liquid crystal display device and wherein the flat panel display further comprises a plurality of row drivers and a plurality of column drivers to perform digital to analog conversion and wherein the controller device supplied the voltages to the plurality of row and column drivers.

DETAILED DESCRIPTION OF THE INVENTION

In the following detailed description of the present invention, a flat panel display having adjustable gamma response without incidental loss of gray scale resolution, numerous specific details are set forth in order to provide a thorough understanding of the present invention. However, it will be obvious to one skilled in the art that the present invention may be practiced without these specific details or with certain alternative equivalent circuits and methods to those described herein. In other instances, well known methods, procedures, components, and circuits have not been described in detail as not to unnecessarily obscure aspects of the present invention.

Figure 1:
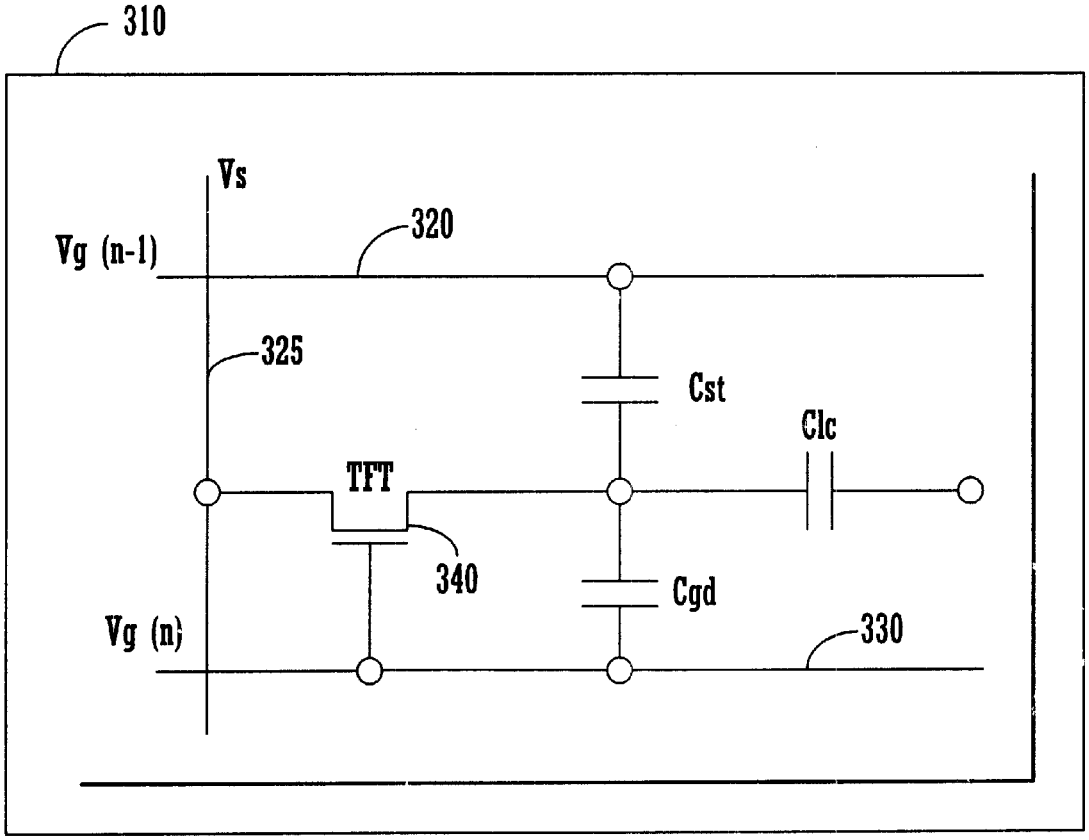
FIG. 1 is a circuit diagram of an exemplary LCD element located at the intersection of a row line and column line.

FIG. 1 illustrates an exemplary equivalent LCD element 310 including a transistor 340 at the intersection of a row line 330 and a column line 325 that can be used in the display screen of the present invention. It is appreciated that any of number of different liquid crystal display screen technologies can be used in accordance with the present invention, e.g., LCD, "supertwist" LCD, "in-plane switching" LCD, "active matrix" TFT LCD, "birefringence" LCD, "patterned vertical aligned" LCD, etc., and that LCD flat panel display technology is illustrated as an exemplary system only. With respect to the LCD element 310, two row lines 320 and 330 are shown. When transistor 340 is addressed, a column voltage is applied over column line 325 and a row voltage is applied over row line 330 to cause a corresponding LCD element to turn-on a predetermined amount based on the net row and column voltage.

The components common to most TFT LCDs that relate to addressing and driving an individual red, green, or blue sub-pixel are: display (pixel) electrode; gate electrode and its bus line; drain electrode and its bus line; common electrode; capacitor; and liquid crystal layer.

In an equivalent circuit for a pixel, there is parasitic capacitance between the drain and source, as well as between the source electrode and the display electrode. The liquid crystal layer and a capacitor are connected as a load on the TFT. By applying a positive pulse to the gate electrode through a gate electrode line, one is able to activate the TFT (turn it "ON"). This causes the signal voltage applied to the source electrode to be transmitted from the source through the drain to the liquid crystal layer and the capacitor, all of which are a load on the TFT.

During this process, the display electrode voltage rises with the gate pulse, and the voltage level at which the gate voltage becomes 0 is maintained and applied to the liquid crystal. The magnitude of this voltage is equivalent to the level of transmissivity or opacity ("gray scale") that the graphics system requires the pixel to maintain during a given frame. While the voltage is changing, the pixel receives another gate pulse. Until another signal voltage is supplied and received, the pixel electrode drives the liquid crystal for approximately 20 ms (for example). This time is about a thousand time longer than that required to write the originating signal voltage. The main purpose of this capacitor is to maintain the voltage on the pixel electrode until the next signal voltage can be written.

It is necessary to address individual sub-pixels with varying and discrete voltage levels to control their transmissivity to make them display equivalent gray levels. There are two basic methods by which to implement this: (1) voltage amplitude modulation (voltage gray scale method); and (2) frame-rate control (frame rate gray scale method). The voltage gray scale method is the more widely used technique for higher performance monitors. The optical transmittance of a liquid crystal changes continuously as a function of the RMS of the applied voltage. The voltage applied to each sub-pixel of the liquid crystal can be varied by changing the amplitude of the signal voltage applied to the source electrode. Either analog or digital Large Scale Integration (LSI) drivers can be used to impart the necessary signals to the Liquid Crystal (although analog drivers tend to be rather large if one is interested in a compact module package). These are arranged, (x, y) matrix style, around the perimeter of the LCD glass package.

The frame-rate control method uses a digital driver of a given number of bits in combination with a frame-rate control method to achieve an increase in the number of gray-scale levels by (usually) one or two bits. In typical cases using a 3-bit driver capable of displaying 8 gray levels per sub-pixel, the gray scale can be increased to 16 levels by employing multiple frames within a given refresh cycle. Various combinations of the basic 8 gray levels are displayed at increased speed, allowing the eye to make composites of these frames and thereby attain the impression of viewing an image with higher color resolution. While this method decreases driver cost, the technique can be difficult to implement resulting in images with noticeable flicker and instability.

Figure 2:
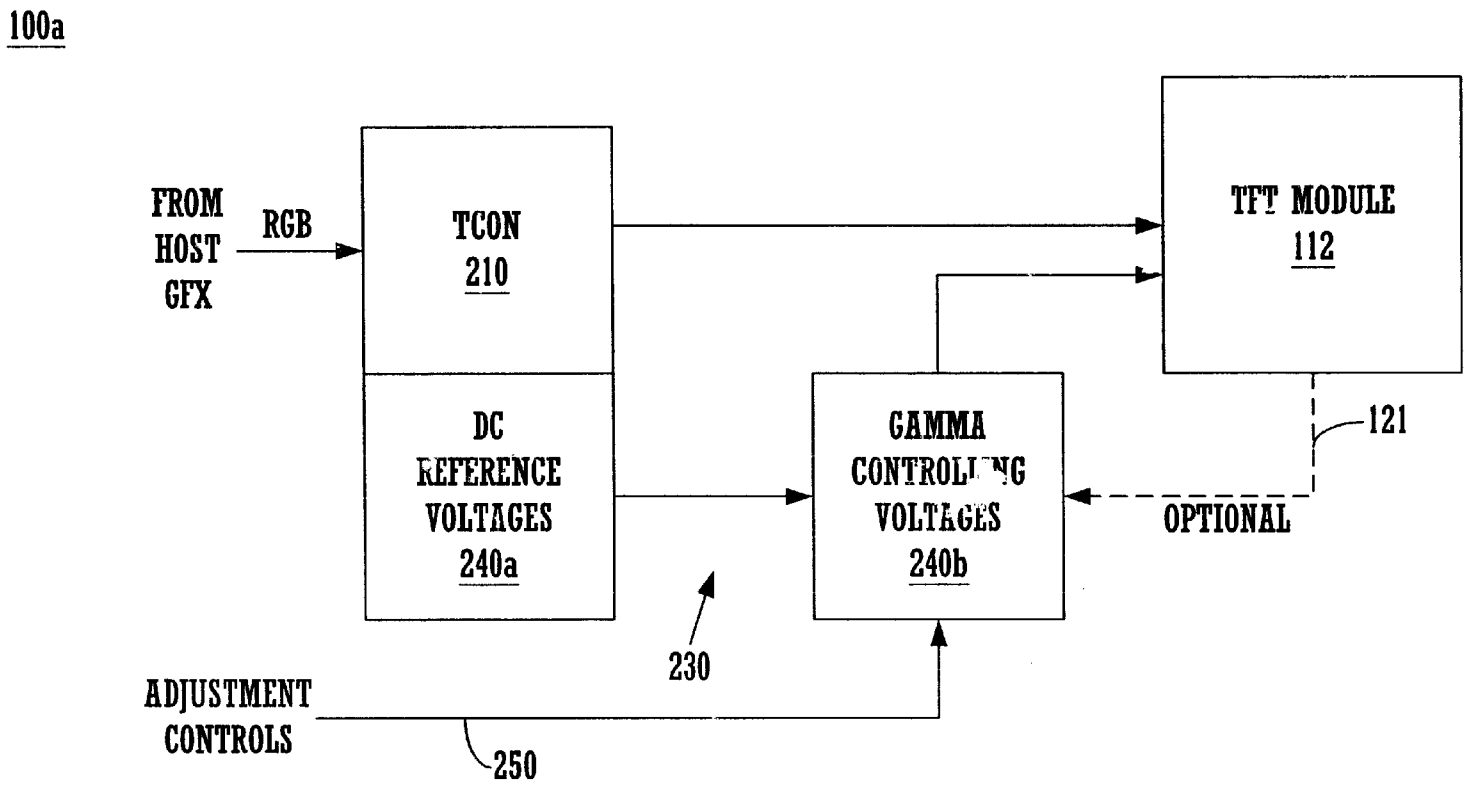
FIG. 2 is a high level block diagram of the flat panel display device in accordance with an embodiment of the present invention.

FIG. 2 illustrates a high level block diagram of a display device 100 in accordance with an embodiment of the present invention. The display device 100*a* contains a timing controller (TCON) circuit 210 that receives input digital RGB (red/green/blue) data from a graphics source (e.g., GFX) that is located within a host device. The TCON circuit 210 drives RGB data into row and column driver circuits of the display 112. In one embodiment, the display screen 112 is a flat panel display screen, e.g., a liquid crystal display (LCD) device but could be of any flat panel technology. Gamma adjustment signals or controls 250 can be used to set new gamma values for the display screen 112. A new gamma response can be determined based on optional feedback 121 from the display screen 112 (a host CPU makes these measurements) and/or a new gamma can be determined based on environmental conditions surrounding the display screen 112, e.g., ambient lighting, etc. A new gamma response can also be received from user input, e.g., a user adjustment knob or any of a number of well known input mechanisms can be used, such as from a digital camera system.

The DC reference voltage circuit 240*a* provides the ON/OFF states of the TFT sub-pixels. The gamma controlling voltage circuit 240*b* adjusts the DC reference voltages to modify the gamma response of the TFT module 112 without reducing its gray scale resolution. If a new gamma is received and/or determined, it is communicated over bus 250 to the gamma controlling voltages circuit 240*b* which is used, in part, to implement the desired gamma profile. The DC reference voltages circuit 240*a* and the gamma controlling voltage circuit 240*b* can be implemented within a single circuit or they can be separate circuits and the form an adjustable ladder circuit (ALC) in one embodiment.

As described in more detail below, the embodiments of the present invention are operable to adjust the gamma of the display screen 112 without requiring RGB LUTs located on the host device's processing software, display controller, or input device. By so doing, the embodiments of the present invention are operable to adjust the gamma of the display screen 112 without incidental degradation of the gray scale resolution of the display screen and loss of color information.

Figure 3:
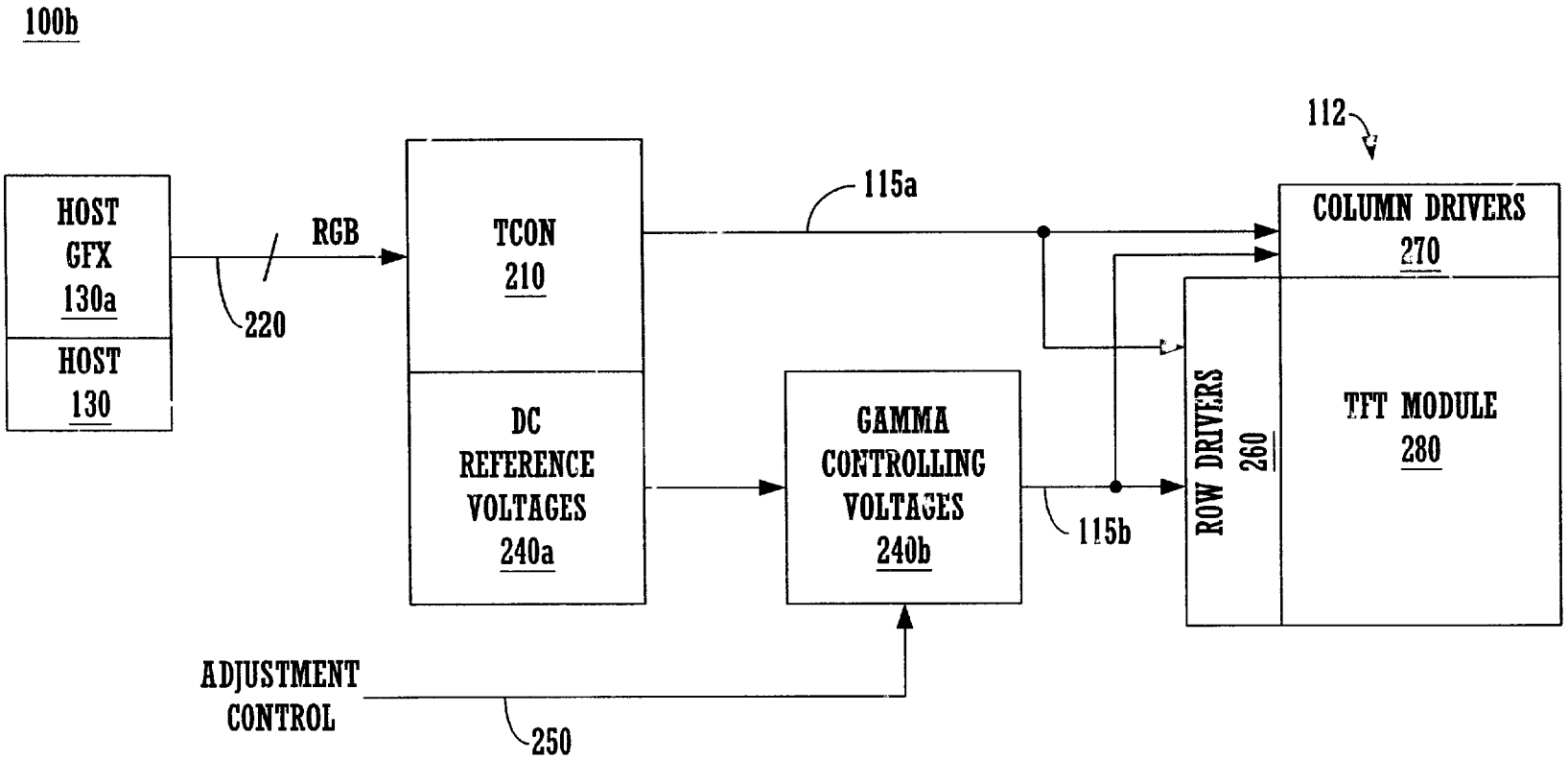
FIG. 3 is a circuit block diagram of the flat panel display device in accordance with an embodiment of the present invention having programmable gamma without incidental loss of gray scale resolution.

FIG. 3 illustrates the logic circuit 100*b* and the display screen 112 in more detail. The Host 130 or Host GFX 130*a* (e.g., the graphics source or card) functions by providing digital RGB data over line 220 to the TCON circuit 210. A digital (or analog) value corresponding to each red, green and blue sub-pixel is provided. It is appreciated that there can be look-up tables (LUTs) located in the Host computer 130 as well as in the graphics card 130*a* that can be mounted within the Host 130. In one embodiment, each of the red, green and blue primary color components have an eight bit gray scale value. The digital value is applied to the row and column driver circuits 260 and 270, through the TCON circuit 210. The row and column driver circuits convert the digital color values to analog voltages proportional to the digital values. It is appreciated that the gamma of the display screen 280 can be altered in accordance with embodiments of the present invention without requiring the use of any LUTs (located within the host 130 or in the host GFX 130*a*).

The display screen 112 contains row drivers 260 and column drivers 270. A number of well known driver circuits can be used to implement the row and column drivers. In accordance with one embodiment, one row is enabled by the row drivers 260 at any time and all column voltages are applied by the column drivers 270 across all columns to produce a single row of an image. This is repeated over all rows sequentially until an entire frame is generated, using well known techniques.

The TCON circuit 210 generates the proper addressing signals and timing signals for addressing the row and column drivers 260 and 270. Any of number of controller circuits can be used for this purpose. In one embodiment, the "TCON" circuit is used. The TCON circuit 210, available from Mitsubishi Electronics, Inc., is coupled to supply addressing signals to the column drivers 270 and to the row drivers 260 via bus 115*a*. Within the proper timing intervals, the TCON circuit 210 supplies digital color data to the column drivers 270 (mainly) and to the row drivers 360 via bus 115*b*. The column drivers 270 and the row drivers 260 convert the digital data into specific voltage values ("voltages") for application to the TFT module 280 using supplied reference voltages from circuit 240*b*. In one embodiment, the driver circuitry can generate up to 256 discrete voltages because the digital data is 8-bits wide. As is well known, the voltages indicate to the display screen how much light to allow through any given LCD element, e.g., how much the LCD element will be energized. The degree to which an LCD element energizes indicates the brightness of the corresponding element. It can be used to turn a pixel "on" if the display is in normally black mode or "off" if the display is in normally white mode.

In accordance with an embodiment of the present invention, a DC reference voltage circuit 240*a* includes a multi-node voltage divider circuit and provides the On/Off settings for the LCD sub-pixels. Circuit 240*a* is coupled to circuit 240*b* and supplies reference voltage signals to circuit 240*b*. Circuit 240*b* then adjusts these reference voltages (according to a desired gamma profile) and supplies the adjusted reference voltages to the row and column drivers of the display screen. Namely, the gamma controlling voltage circuit 240*b* modifies the DC reference voltages to thereby produce a proportional change in the voltage applied across the LCD sub-pixel. This change is also proportional to the input digital value causing an overall change in the gamma response of the display 112. It is appreciated that circuit 240*a* and circuit 240*b* can be referred to as an adjustable voltage ladder circuit (ALC).

It is appreciated that a separate ALC circuit can be supplied for each red, green and blue primary. Circuit 240*b* is coupled to receive control signals over line 250 from a controller device (not shown). In one embodiment, the controller device can be under software control and can be controlled by a host computer. The controller device functions to program the discrete reference voltages that the ALC circuit can generate. By altering the values of the discrete reference voltages generated by the ALC circuit, the controller device can alter the gamma profile of the display screen 280 without degrading its gray scale resolution and without requiring the use of gamma data LUTs within the host computer or graphics card 130. By providing the capability, the present invention offers a flat panel display screen having the ability to display all colors with their original fidelity and depth at any gamma value. Gamma can be altered without restricting the dynamic range of colors that can be displayed using the display screen 112.

By adjusting, in a predetermined fashion, the reference voltages generated by the ALC circuit and applied to the row and column drivers of the display 112, the gamma response of the display can be changed to a different value in accordance with an embodiment of the present invention. Because the input digital signals over line 220 are not affected, the same color resolution and dynamic range are maintained by the present invention, but the gamma is now a function of the setting of the reference voltages and does not necessarily require extraneous and costly LUTs to be manipulated.

Figure 4:
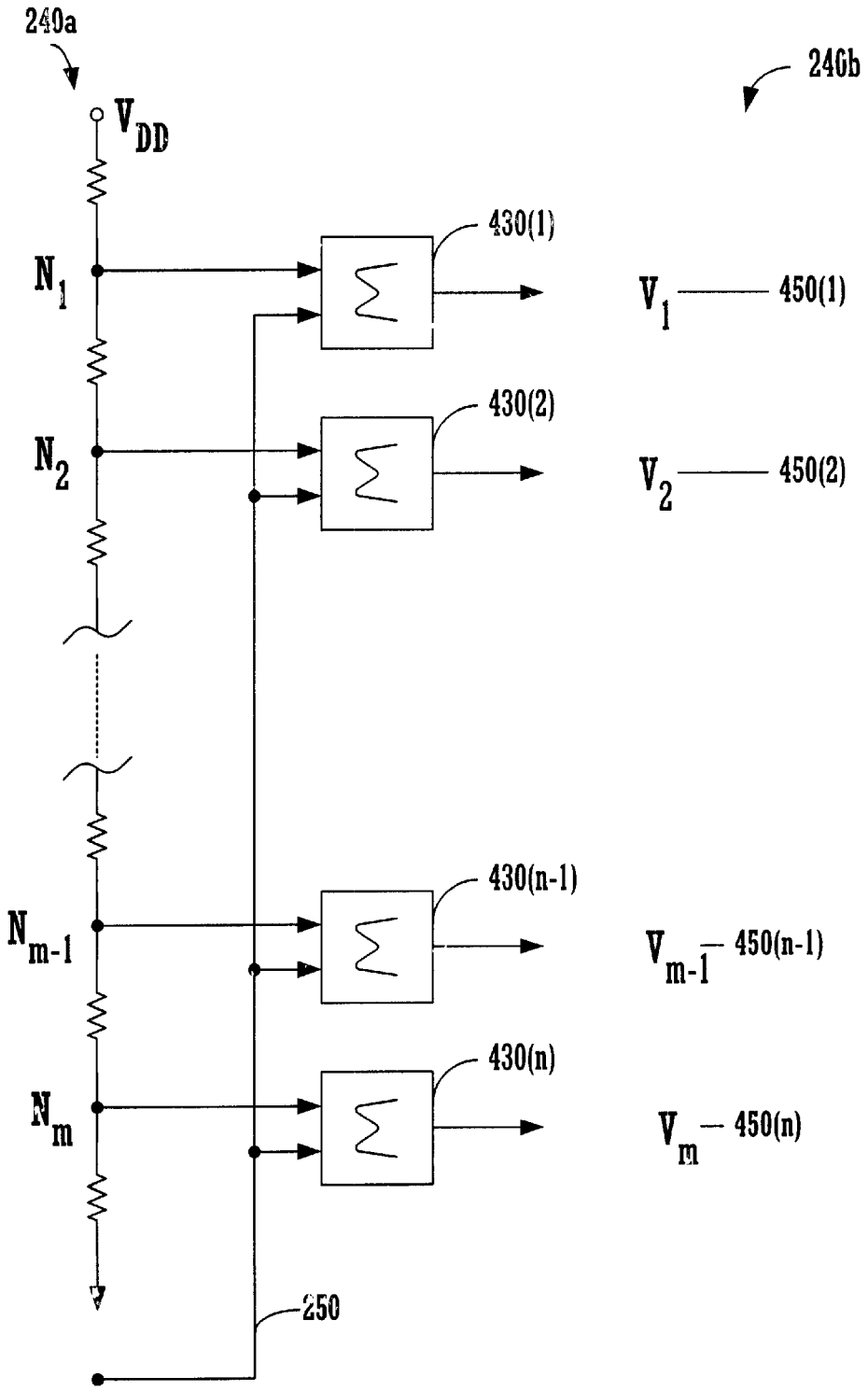
FIG. 4 is a circuit diagram of an adjustable ladder circuit, of a digital to analog converter circuit, for generating programmable reference voltages in accordance with one embodiment of the present invention.

FIG. 4 illustrates one embodiment of the ALC circuit 240*a* and 240*b*. Circuit 240*a* is a multi-node voltage divider circuit having multiple resistors (N1–Nn) coupled in series fashion. In this embodiment, the ALC circuit contains n serially coupled stages, each stage having a programmable summing amplifier circuit 430(0)–430(n) that is coupled, respectively, to a node along the multi-node voltage divider circuit 240*a*. Therefore, each node of the reference voltage circuit 240*a* feeds into one of the inputs of a programmable summing amplifier circuit. Any number of well known programmable summing amplifier circuit can be used. The adjustment control voltage (of bus 250) provides the other input of the respective summing amplifier. Therefore, each of the programmable summing amplifier circuits 430(0)–430(n) is coupled to a respective control or programming line from control signals 250.

The adjustment control signals 250 can originate from a low impedance source adjustable through software or from a mechanical potentiometer circuit. In this fashion, a control circuit generating signals 250 can program each and every one of the programmable summing amplifier circuits 430(0)–430(n) and thereby control the reference voltages generated by the ALC circuit. In the embodiment shown, the first stage of the divider circuit 240*a* is coupled to Vdd and the last stage 430(n) is coupled to ground. Each stage of the ALC circuit generates a discrete reference voltage 450(0)–450(n), also called V(0)–V(n). These adjusted reference voltage signals 450(0)–450(n) are applied to the row and column drivers of the flat panel display. It is appreciated that a separate ALC circuit a can be provided for each of the red, green and blue primary color components.

The controller device can program the discrete reference voltages, V(0)–V(n), by altering the summing amount at each stage of the ALC circuit. Because these discrete reference voltages are used during the digital to analog conversion process of the row and column drivers, the controller device can effectively alter the gamma of the display screen by altering these reference voltage values.

Figure 5:
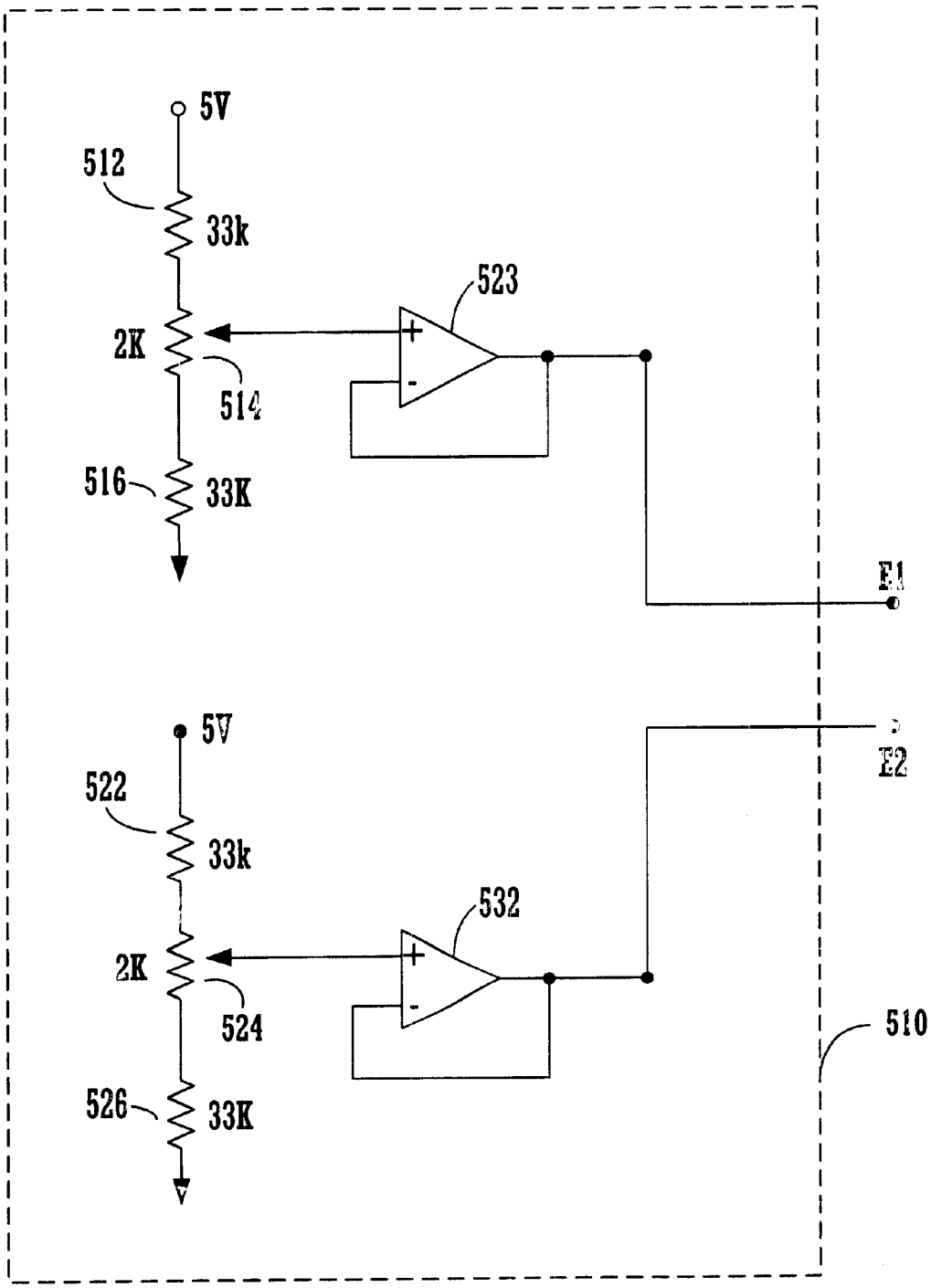
FIG. 5 and FIG. 6 are a circuit diagram of an adjustable ladder circuit, of a digital to analog converter circuit, for generating programmable reference voltages in accordance with another embodiment of the present invention.
Figure 6:
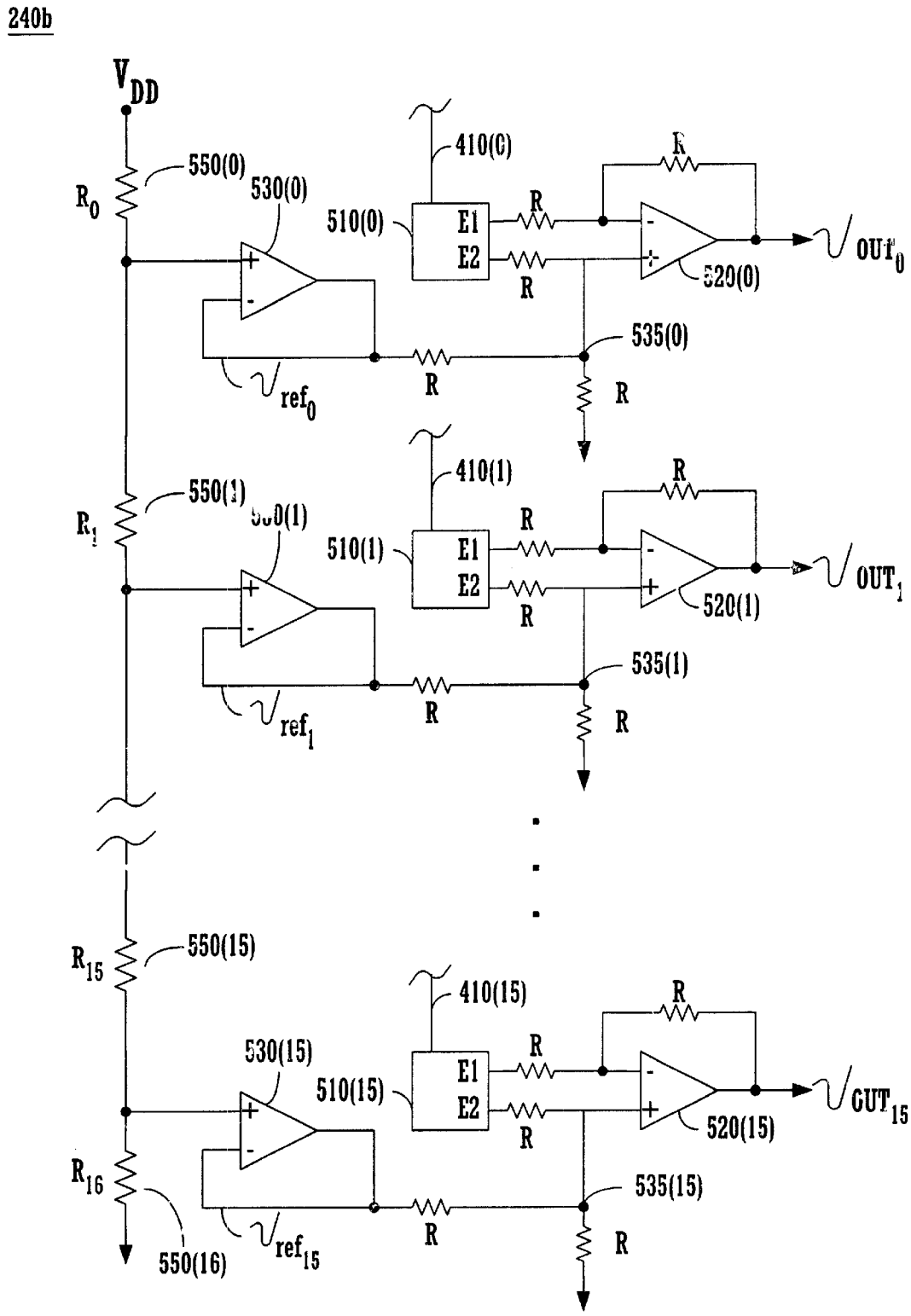

FIG. 5 and FIG. 6 illustrate another embodiment of the ALC circuit 240*b*. It is appreciated that FIG. 5 is exemplary only and is a specific implementation of the adjustment control using a mechanical potentiometer circuit. Circuit 510 generates two voltage values, E1 and E2 for future discussions. Voltage value E1 is generated by the following circuit of FIG. 5. A resistor 516 is coupled to a low voltage or ground and also coupled to a programmable potentiometer 514 which is coupled in series to a resistor 512 which is coupled to 5 v. The programmable potentiometer 514 is coupled to the non-inverting terminal of buffer (operational amplifier) 523 and the inverting terminal is coupled to the output of the buffer 523. The voltage value E1 is generated at the output of the buffer 523. Voltage value E2 is generated by the following circuit. A resistor 526 is coupled to a low voltage or ground and also coupled to a programmable potentiometer 524 which is coupled in series to a resistor 522 which is coupled to 5 v. The programmable potentiometer 524 is coupled to the non-inverting terminal of buffer 532 (operational amplifier) and the inverting terminal is coupled to the output of the buffer 532. The voltage value E2 is generated at the output of the buffer 532. It is appreciated that programmable potentiometers 514 and 524 can be controlled by a control line (not shown in FIG. 5) from the controller device 250.

FIG. 6 illustrates the ALC circuit 240*b* in accordance with an embodiment of the present invention. It is appreciated that FIG. 6 illustrates an exemplary and specific implementation of the summing amplifier. Only 16 nodes are shown in FIG. 6 as an example, but it is appreciated that the ALC circuit 240*b* can be implemented in a variety of stages. Each stage, i, contains its own circuit 520(*i*) and generates a discrete reference voltage, Vouti. The 16 stages of the ALC circuit 240*b* generate reference voltages Vout(0)–Vout(15). Voltage Vdd is coupled to a resistor, R0 550(0) which is coupled to the non-inverting terminal of buffer (operational amplifier) 530(0). The negative terminal is coupled to the output of the buffer 530(0) which is also coupled to a resistor which is coupled in series to node 535(0) which is coupled through another resistor to ground (or a low voltage source). Circuit 510(0) generates a voltage E1 which is coupled through a resistor to the inverting terminal of buffer (operational amplifier) 520(0). Circuit 510(0) also generates a voltage E2 which is coupled through a resistor to the non-inverting terminal of buffer 520(0) which is also coupled to node 535(0). The non-inverting terminal is coupled through a resistor to the output of the buffer 520(0) which supplies the output reference voltage (Vout0) for this stage. It is appreciated that programming line 410(0) is coupled to controller 250 to allow programming of the voltage values E1 and E2.

The output voltage, Vout0, can be expressed according to the following relationship:

$$V\text{out}0 = V\text{ref}0 + E2 - E1$$

wherein E2 and E1 correspond to circuit 510(0). It is appreciated that any of the discrete reference voltages, Vouti, can be expressed according to:

$$V\text{out}i = V\text{ref}i + E2 - E1$$

wherein E2 and E1 correspond to circuit 510(i).

Resistor R1 550(1) is coupled in series to resistor R0 and resistor R1 is also coupled to an analogous stage circuit containing circuit 510(1), buffer 530(1), circuit 510(1), and buffer 520(1). The output reference voltage, Vout(1), is controlled by program line 410(1). The above circuit is replicated for each state of the ALC 240*b*. For instance, resistor R15 550(15) is coupled in series to resistor R16 and resistor R15 is also coupled to an analogous stage circuit containing circuit 510(15), buffer 530(15), circuit 510(15), and buffer 520(15). The output reference voltage, Vout(15), is controlled by program line 410(15). Resistor 16 is coupled to ground, or to a low voltage source. The discrete reference voltages, Vout(0)–Vout(15) of ALC 240*b* are programmed by controller 250 via lines 410(0)–410(15). As stated above, by controlling the values of the discrete reference voltages generated by ALC 240*b*, the controller 250 can alter the gamma response (or profile) of the display screen without reducing its gray scale resolution or color depth. It is appreciated that a separate circuit 240*b* can be provided for each of the red, green and blue primary color components.

It is appreciated that the column driver circuits can be programmed to accept the discrete reference voltages from the ALC and to supply a continuous gamma adjustment, e.g., all gamma responses from gamma 1.0 to gamma 3.0 (for instance) would be generated or, alternatively, they could be programmed to supply n discrete settings. In the latter case, specific discrete gamma responses would be available such as gamma 1.8, 2.2, 2.8, etc. Both implementations are considered within the scope of the present invention.

The preferred embodiment of the present invention, a flat panel display having adjustable gamma response (or profile) without incidental loss of gray scale resolution, is thus described. While the present invention has been described in particular embodiments, it should be appreciated that the present invention should not be construed as limited by such embodiments, but rather construed according to the below claims.

What is claimed is:

1. A monitor comprising:

a) a flat panel display comprising:
a matrix of pixels;
row drivers coupled to said matrix; and
column drivers coupled to said matrix, said row and column drivers for converting digital color data into voltages for application to said matrix;

b) a timing controller circuit operable to produce timing signals for sequencing digital data to said row and column drivers;

c) a reference voltage circuit for providing a plurality of discrete analog reference voltages;

d) an adjustment circuit coupled to said reference voltage circuit and operable to produce a plurality of adjusted discrete analog reference voltages supplied to said row and column drivers, said adjustment circuit operable to alter the gamma profile of said flat panel display without degrading its gray scale resolution; and e) a controller device for generating control signals, said control signals for controlling said adjustment circuit to selectively implement a desired gamma profile of said flat panel display and wherein said controller device is a software controller device.

2. A monitor as described in claim 1 wherein said reference voltage circuit and said adjustment circuit are an adjustable ladder circuit.

3. A monitor as described in claim 2 wherein said adjustable ladder circuit comprises a plurality of serially coupled voltage stages, each stage comprising a programmable summing amplifier and each stage operable to generate a respective adjusted discrete analog reference voltage.

4. A monitor as described in claim 1 wherein said flat panel display screen is a liquid crystal display (LCD) device.

5. A display device comprising:

a) a flat panel display comprising:
a matrix of liquid crystal display (LCD) elements;

row drivers coupled to said matrix; and column drivers coupled to said matrix, said row and column drivers for converting digital color data into voltages for application to said matrix;

b) a timing controller circuit operable to produce timing signals for sequencing digital data through said row and column drivers;

c) a reference voltage circuit for providing a plurality of discrete analog reference voltages;

d) an adjustment circuit coupled to said reference voltage circuit and operable to produce a plurality of adjusted discrete analog reference voltages supplied to said row and column drivers, said adjustment circuit operable to alter the gamma profile of said flat panel display without degrading its gray scale resolution; and e) a controller device for generating control signals, said control signals for controlling said adjustment circuit to implement a desired gamma profile of said flat panel display and wherein said controller device is a software controller device.

6. A display device as described in claim 5 wherein said matrix is a color matrix having three or more primary colors (RGB).

7. A display device as described in claim 5 wherein said reference voltage circuit and said adjustment circuit are an adjustable ladder circuit.

8. A display device as described in claim 7 wherein said adjustable ladder circuit comprises a plurality of serially coupled voltage stages, each stage comprising a programmable summing amplifier and each stage operable to generate a respective adjusted discrete analog reference voltage.

9. In a display device, a method of generating an image comprising the steps of:

a) receiving digital color data representing pixels for display;

b) converting said digital color data into voltages for application to a flat panel display screen, wherein said step b) comprises the steps of:

b1) programming a plurality of programmable analog reference voltages of an adjustable ladder circuit in order to obtain a desired gamma profile of said flat panel display screen without degrading its gray scale resolution, wherein said step b1) is performed by a software controller device and further comprising the step of accessing said desired gamma profile from a user input; and b2) supplying said plurality of programmable analog reference voltages and digital color data to row and column drivers to convert said digital color data into said voltages; and c) applying said voltages said flat panel display screen, said flat panel display screen having a matrix of pixels comprising rows and columns.

10. A method as described in claim 9 wherein said flat panel display device is a liquid crystal display (LCD) device.

11. A method as described in claim 9 further comprising the step of generating required timing signals for addressing said row and column drivers of said flat panel display screen.

12. A method as described in claim 9 wherein said adjustable ladder circuit comprises a plurality of serially coupled voltage stages, each stage having a programmable summing amplifier and each stage generating a discrete programmable analog reference voltage.

13. A method as described in claim 9 further comprising the step of said display screen automatically responding to an input device to readjust its gamma profile to mach said input device.

14. A method as described in claim 13 wherein said input device is a digital camera system.

15. A monitor comprising:

a) a flat panel display comprising:

a matrix of pixels;

row drivers coupled to said matrix; and column drivers coupled to said matrix, said row and column drivers for converting digital color data into voltages for application to said matrix;

b) a timing controller circuit operable to produce timing signals for sequencing digital data to said row and column drivers;

c) a reference voltage circuit for providing a plurality of discrete analog reference voltages;

d) an adjustment circuit coupled to said reference voltage circuit and operable to produce a plurality of adjusted discrete analog reference voltages supplied to said row and column drivers, said adjustment circuit operable to alter the gamma profile of said flat panel display without degrading its gray scale resolution; and e) a controller device for generating control signals, said control signals for controlling said adjustment circuit to selectively implement a desired gamma profile of said flat panel display, and wherein said controller device comprises potentiometer circuits.

16. A monitor as described in claim 15 wherein said reference voltage circuit and said adjustment circuit are an adjustable ladder circuit.

17. A monitor as described in claim 16 wherein said adjustable ladder circuit comprises a plurality of serially coupled voltage stages, each stage comprising a programmable summing amplifier and each stage operable to generate a respective adjusted discrete analog reference voltage.

18. A monitor as described in claim 15 wherein said flat panel display screen is a liquid crystal display (LCD) device.

19. A display device comprising:

a) a flat panel display comprising:

a matrix of liquid crystal display (LCD) elements;

row drivers coupled to said matrix; and column drivers coupled to said matrix, said row and column drivers for converting digital color data into voltages for application to said matrix;

b) a timing controller circuit operable to produce timing signals for sequencing digital data through said row and column drivers;

c) a reference voltage circuit for providing a plurality of discrete analog reference voltages;

d) an adjustment circuit coupled to said reference voltage circuit and operable to produce a plurality of adjusted discrete analog reference voltages supplied to said row and column drivers, said adjustment circuit operable to alter the gamma profile of said flat panel display without degrading its gray scale resolution; and e) a controller device for generating control signals, said control signals for controlling said adjustment circuit to implement a desired gamma profile of said flat panel display and wherein said controller device comprises potentiometer circuits.

20. A display device as described in claim 19 wherein said matrix is a color matrix having three or more primary colors (RGB).

21. A display device as described in claim 19 wherein said reference voltage circuit and said adjustment circuit are an adjustable ladder circuit.

22. A display device as described in claim 21 wherein said adjustable ladder circuit comprises a plurality of serially coupled voltage stages, each stage comprising a programmable summing amplifier and each stage operable to generate a respective adjusted discrete analog reference voltage.

* * * * *